US006726186B2

(12) United States Patent
Gaaloul et al.

(10) Patent No.: US 6,726,186 B2
(45) Date of Patent: Apr. 27, 2004

(54) APPARATUS FOR CLEANING AND REFRESHING FABRICS WITH AN IMPROVED ULTRASONIC NEBULIZER

(76) Inventors: Sonia Gaaloul, 93 rue du Busselenberg, Bte 3, B-1070 Brussels (BE); Josst Ignace Dewaele, Waregemstraat 29, B-8570 Vichte (BE); Tim Maria Joris Van Hauwermeiren, Langestraat 179, B-1790 Hekelgem-Affigem (BE); Bruno Albert Jean Hubesch, Langestraat 55, B-3040 Neerijse-Huldenberg (BE)

( * ) Notice: Subject to any disclaimer, the term of this patent is extended or adjusted under 35 U.S.C. 154(b) by 0 days.

(21) Appl. No.: 09/928,046

(22) Filed: Aug. 10, 2001

(65) Prior Publication Data

US 2002/0053607 A1 May 9, 2002

(51) Int. Cl.[7] ..... B01F 3/04
(52) U.S. Cl. ..... 261/81; 239/102.2
(58) Field of Search ..... 261/81, DIG. 48; 239/102.2

(56) References Cited

U.S. PATENT DOCUMENTS

| | | | | |
|---|---|---|---|---|
| 3,206,124 | A | * | 9/1965 | Drayer et al. |
| 3,561,444 | A | | 2/1971 | Boucher |
| 3,774,602 | A | * | 11/1973 | Edwards |
| 3,828,773 | A | * | 8/1974 | Buch et al. |
| 4,164,306 | A | | 8/1979 | Perrin et al. |
| 4,290,384 | A | * | 9/1981 | Ausschnitt et al. |
| 4,765,515 | A | | 8/1988 | Lippman et al. |
| 4,911,866 | A | * | 3/1990 | Monroe ..... 261/81 |
| 4,976,259 | A | * | 12/1990 | Higson et al. |
| 5,038,812 | A | | 8/1991 | Norman et al. |
| 5,141,120 | A | | 8/1992 | Brown et al. |
| 5,176,856 | A | | 1/1993 | Takahashi et al. |
| 5,260,345 | A | | 11/1993 | DesMarias et al. |
| 5,328,055 | A | | 7/1994 | Battle et al. |

(List continued on next page.)

FOREIGN PATENT DOCUMENTS

| | | | |
|---|---|---|---|
| DE | 1813776 | | 6/1970 |
| DE | 2357646 | | 5/1975 |
| DE | 19713496 | A1 | 10/1998 |
| EP | 1182292 | A1 * | 2/2002 |
| FR | 1404191 | | 11/1965 |
| GB | 2 334 907 | A | 9/1999 |
| WO | WO 00/28874 | | 5/2000 |
| WO | WO 00/68618 | | 11/2000 |
| WO | WO 00/75413 | A1 | 12/2000 |

*Primary Examiner*—Scott Bushey
(74) *Attorney, Agent, or Firm*—Caroline Wei-Berk; Kim W. Zerby; Steve W. Miller

(57) ABSTRACT

One aspect of the present invention is directed to an ultrasonic nebulizer for use in a portable and collapsible cleaning and refreshing apparatus for treating fabric garments. The ultrasonic nebulizer contains a housing, the housing being divided into at leant two compartments by a membrane, preferably made out of a flexible film, more preferably made out of an inox film, such that at least one compartment is liquid and vapor tight, the nebulizer further comprising at least one piezoelectric vibrator for ultrasonic wave generation and located in the liquid and vapor sight compartment, a high-frequency generator for exciting the piezoelectric vibrator, wherein the liquid or gel medium is heated by a built-in heating device to a temperature of at least 30° C., preferably at least 40° C., more preferably at least 50° C.

9 Claims, 2 Drawing Sheets

U.S. PATENT DOCUMENTS 5,358,147 A 10/1994 Adams et al.
5,456,945 A * 10/1995 McMillan et al.
5,485,828 A * 1/1996 Hauser ..... 239/102.2
5,487,489 A 1/1996 Weiss et al.
5,503,302 A 4/1996 DeJonge
5,509,578 A 4/1996 Livingstone et al.
5,540,959 A * 7/1996 Wang
5,550,167 A 8/1996 DesMarias et al.
5,630,847 A 5/1997 Roetker et al.
5,650,222 A 7/1997 DesMarias et al.
5,789,368 A 8/1998 You et al.
5,791,525 A 8/1998 Fan et al.
5,815,961 A 10/1998 Estes et al.
5,960,840 A 10/1999 Simmel et al.
5,992,698 A 11/1999 Copeland et al.
5,992,705 A 11/1999 Lhuisset et al.
6,189,346 B1 2/2001 Chen et al.
6,401,984 B1 6/2002 Jumel et al.
6,464,105 B1 10/2002 Rolle et al.
2002/0053607 A1 * 5/2002 Gaaloul et al. ..... 239/102.2
2002/0079329 A1 * 6/2002 Verherbrugghen et al.
2002/0154011 A1 * 10/2002 Pasin et al.

* cited by examiner

APPARATUS FOR CLEANING AND REFRESHING FABRICS WITH AN IMPROVED ULTRASONIC NEBULIZER

This application claims priority to EP patent application 00 870 179.9 filed Aug. 16, 2000.

TECHNICAL FIELD

The present invention relates to apparatuses useful for cleaning and refreshing fabrics in a non-immersion cleaning process, which comprise an ultrasonic nebulizer for dispensing of a cleaning and refreshing composition, and to an improved nebulizer.

BACKGROUND OF THE INVENTION

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and the solvent must be reclaimed, making the process unsuitable for in-home use. Hence, dry-cleaning has traditionally been restricted to commercial establishments making it less convenient and more costly than in-home laundering processes.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the bag together with the sheet, and then tumbled in a conventional clothes dryer. In a current commercial embodiment, multiple single-use flat sheets comprising a cleaning/refreshing agent and a single multi-use plastic bag are provided in a package.

Unfortunately, such in-home processes are designed for use in a conventional clothes dryer, or the like apparatus. Such apparatuses are not always readily available, and they are often uneconomical. Moreover, in many countries clothes dryers are simply unnecessary. For example, in many warm tropical regions people do not typically own clothes dryers because their clothes can be dried year-round by hanging them outside in the sun. In the areas of the world where people do not typically own clothes dryers, products that require a heating apparatus, such as a clothes dryer, are of little or no value.

Steamer cabinets have also been utilized in the past to treat fabric articles with heavy doses of steam. Unfortunately, past steam cabinets were largely uncontrolled with respect to temperature and humidity. The cabinets were generally large appliances that were not portable. And due to the large amount of steam used, a drying step is often required that puts strain on the fabrics. The drying step also requires additional time and energy, and often results in undesirable shrinkage.

Thus, there was a need to develop a domestic, non-immersion cleaning and refreshing process, and cleaning and refreshing compositions for use therein, which provides acceptable cleaning without the need for a tumble dryer. Moreover, there is a need for apparatuses that can regulate both temperature and relative humidity within a container during a domestic, non-immersion cleaning and refreshment process, wherein dry clean only fabrics are cleaned, de-wrinkled and refreshed.

Thus, apparatuses were developed for treating a fabric article which include a collapsible or expandable container that is made from a material that defines an interior void space having an open volume, and an opening. Such known apparatuses also include a humidity provider; a heating element; a hangar for suspending at least one fabric article within the interior void space of the container; a vent; and an air circulation device. The container can be collapsed so that the apparatus is portable. The heating element that is used in such known apparatuses is typically a steaming unit or equivalent which volatilizes the refreshing and cleaning composition by heating it up to its volatilizing temperature.

However, it appears that such steaming units are limited only to use with refreshing and cleaning compositions which contain volatile compounds. Thus, nowadays, the only way to deliver non-volatile compounds to a fabric article to be treated in such apparatuses is to use a hand spray (or the like, for example aerosol cans . . . etc.) before actually closing the apparatus for a refreshing and cleaning cycle. Such an operation is fastidious for the user, and moreover, it does not provide an homogeneous coverage of the garments with the non-volatile composition (preferably, only the visibly soiled wrinkled areas are covered by the user).

Thus, there is a need for an automatic portable apparatus for treating a fabric article, as previously described that comprises means to deliver, in an homogeneous way, non-volatile as well as volatile compounds onto the fabric article to be treated.

SUMMARY OF THE INVENTION

The present invention is firstly directed to an apparatus for treating a fabric article which includes a collapsible or expandable container that is made from a material that defines an interior void space having an open volume of between about 0.75 $m^3$ and about 0.05 $m^3$, and an opening. The apparatus also includes a humidity provider which is achieved by an ultrasonic nebulizer element for dispersing the refreshing and cleaning composition onto the fabric article; a hangar for suspending at least one fabric article within the interior void space of the container; a vent; a heating element for controlling the temperature inside said void space of said apparatus; and an air circulation device. The container can be collapsed to at least about 50%, preferably at least about 40%, and more preferably at least about 25% of its open volume.

One other aspect of the present invention is directed to an ultrasonic nebulizer for use in a portable and collapsible cleaning and refreshing apparatus for treating fabric garments. Said ultrasonic nebulizer comprises a housing, said housing being divided into at least two compartments by a membrane, preferably made out of a flexible film, more preferably made out of an inox film, such that at least one compartment is liquid and vapor tight, said nebulizer further comprising at least one piezoelectric vibrator for ultrasonic wave generation and located in said liquid and vapor tight compartment, a high-frequency generator for exciting said piezoelectric vibrator, wherein said liquid or gel medium is heated by a built-in heating means to a temperature of at least 30° C., preferably at least 40° C., more preferably at least 50° C.

BRIEF DESCRIPTION OF THE DRAWINGS

While this specification concludes with claims that distinctly define the present invention, it is believed that these claims can be better understood by reference to the Detailed Description Of The Invention and the drawings, wherein:

DETAILED DESCRIPTION OF THE INVENTION

Figure 1:
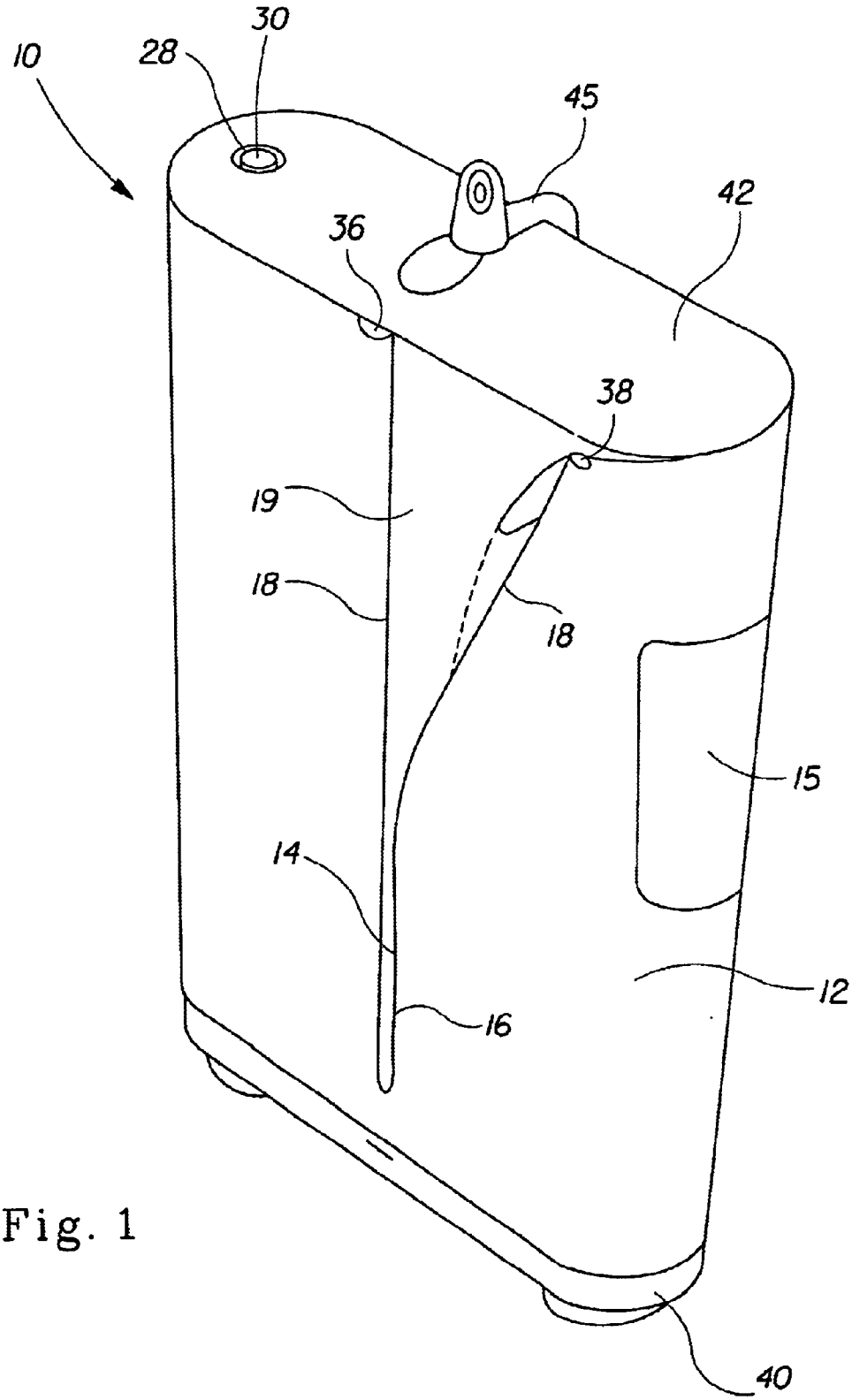
FIG. 1 is a perspective schematic view of a fabric refreshing/cleaning apparatus as described in the context of the present invention.

The present invention provides apparatuses for cleaning and refreshing fabric articles in a domestic, non-immersion process. The apparatuses are suitable for use in a cleaning and refreshing method that requires at least two steps, and preferably three. The temperature and relative humidity within the fabric treatment apparatus can be manipulated and controlled to create a warm, humid environment inside the container of the fabric treatment apparatus. This controlled environment volatilizes malodor components in the manner of a "steam distillation" process, and moistens fabrics and the soils thereon. This moistening of fabrics can loosen pre-set wrinkles, and because the fabric articles are hung in the container new wrinkles do not form. Proper selection of the amount of the vapor, and specifically the amount of water used in the process and, importantly, proper venting of the container in the present manner can minimize shrinkage of the fabrics. Moreover, if the container is not vented, the volatilized malodorous materials removed from the fabrics, which are not captured by the filter if present, can undesirably be re-deposited thereon.

Relative humidity is a well known concept to those in the fabric care arts. As used herein, "relative humidity" means the ratio of the actual amount of water vapor in the air to the greatest amount the air can hold at the same temperature.

Temperature and relative humidity controllers are well known to those skilled in the art, as are passive and active controllers. As used herein, an "active" controller is a controller that reads an input and supplies feedback to the device being controlled and that device adjusts based on the feedback received. A "passive" controller, as used herein, is a controller that turns a device on or off, or opens or closes a device, based on a predetermined setting such as time. For example, a passive temperature controller would turn on a heating element or close a vent to increase the temperature in a given environment and after a certain period of time the heating element is turned off or the vent is opened. In contrast, an active temperature controller reads the temperature and if, for example, the temperature is too low, the power to the heating element is increased or the vent is closed to increase the temperature.

As used herein "fabric articles" is meant to encompass any and all articles of manufacture that are made at least partially of a natural or manmade fibrous material. Examples of fabric articles include, but are certainly not limited to: toys, shoes upholstery, garments, carpets, clothes hats, socks, towels, draperies, etc.

Apparatus

The fabric care apparatuses of this invention can take a variety of forms. But it is generally preferred that the apparatuses comprise a container that substantially encloses the fabric articles being cleaned and refreshed. By "substantially encloses", it is meant that the fabric articles are enclosed in the container, but that the container can, and preferably will, include one or more vents. The container must have an opening to access the fabric articles, and preferably, there is a bar, hook or other device on which to hang the fabric articles.

The container preferably has only one wall configured like an egg shell. It has been found that the vapor, and subsequently the active ingredients, preferentially condense in the corners and along the sharp edges of a more conventional rectangular shaped cabinet. This is not to say that the methods of this invention cannot be conducted in rectangular cabinets; they can. Regardless of its shape, every container has an "open volume" which as used herein means the volume of the container when it is in use. The containers of this invention are collapsible or expandable and have a substantially reduced volume in their closed or collapsed state.

Referring now to FIG. 1, which is a schematic representation of a fabric treatment apparatus (10) according to the present invention (also referred to in the following description as a refreshing/cleaning apparatus or device) wherein the collapsible or expandable, preferably flexible walls (18) of container (12) are preferably made of a flexible material, which is preferably a lined fabric material. And more preferably the lining is a coating applied to the fabric by methods known to those skilled in the art such as transfer coating, direct coating. The fabric is preferably selected from the group consisting of cotton, polyester, nylon, rayon and mixtures thereof, and the lining is preferably selected from the group consisting of silicone, polyurethane, polyvinyl chloride and mixtures thereof. Collapsible or expandable walls (18) of container (12) define an interior void space (19), which is preferably supported by one or more rigid, yet collapsible frames. These frames can be separate from one another, or they can be a unitary structure. Interior void space (19) can be viewed via window (15) if collapsible or expandable walls (18) are made of an opaque material.

It is understood that while treatment apparatus (10) is shown in a rounded rectangular configuration, the present invention is not meant to be so limited. Other structural configurations are appropriate for this invention, for example, pyramid, spherical, hemi-spherical, two-sided/garment bag and other configurations. Treatment apparatus (10) can be any appropriate size and shape to achieve the desired volumetric sizes disclosed herein. Fastener (16), which seals opening (14), can comprise virtually any blown sealing device such as zippers, tape, ZIP LOCK® seals and hook and loop type fasteners, for example VELcRO®. In one preferred embodiment of the present invention, the apparatus (10) comprises a fastening means to secure the zip (16) in closed position. It has been found chat there is a risk of accidentally opening the container (12) while the apparatus (10) is running. There is some risk of injury for the user as apparatus may contain very hot vapors, and/or such compounds as ozone. There is also a risk that the user be injured by inhaling very small particles of nebulized refreshing/cleaning composition, which will go very deep into the respiratory system, which can be undesirable or unhealthy to the user. The fastening means can be of any suitable sort that allows to block the zip (16) in closed position. In a first embodiment, it is achieved by a hook onto the movable portion (38) of the zip (16) that is caught by a buckle of the stationary portion (36) of the zip (16). Once the user has closed the container (12), the movable portion (38) of the zip (16) is close to the buckle, so the user can fasten the zip by passing the hook into the buckle. In a second and preferred embodiment of the present invention, the fastening means is achieved by a system similar to the ones used for fastening the seatbelt in cars or planes. In addition, this system is completed by an electrical security latch that is linked to the main power switch of the apparatus. Once the container is closed, the user fastens the zip to lock it. Once the user pushes on the main switch to start a cycle, an electrical contact makes the fastening means impossible to unlock until the end of the cycle.

The containers of the present invention preferably comprise a rigid top portion (42) and a rigid bottom portion (40), which gather to form a receptacle for the container when it is collapsed. If a frame is employed, the rigid portions of the container can serve a support for the frame, or the frame and the rigid portion can be separate items that are not connected to one another. Preferably the frame or frames form a flexible, collapsible structure that when expanded forms a semi-rigid, three dimensional structure. Examples of collapsible structures are known, for example, in U.S. Pat. No. 5,038,812, which issued on Aug. 13, 1991, to Norman. In general, flexible, collapsible frames, such as those found in Norman, are formed from material that is relatively strong but nevertheless flexible enough to allow it to be collapsed. An exemplary frame material is flat spring steel having a rectangular cross section with dimensions of 1.6 mm in width and 76 mm in length. The frame or frames can be sewn, glued or otherwise attached to the interior or the exterior of the treatment bag. Likewise, the frame or frames can be free standing with the treatment bag material hanging loosely over, or being expanded by the frame.

As is discussed briefly above, the apparatuses of this invention are collapsible. That is, the container can be folded to substantially reduce its volume. More preferably, the container collapses into a receptacle that can be formed by the rigid portions of the container, or the receptacle can be a separate item. The receptacle need not be rigid, but can be any suitable storage unit for the collapsed container. Preferably the container comprises a handle that makes it easier to transport the collapsed container from one place to another. Even more preferably, the handle also serves as the exterior hanging means (45), which is used to hang the apparatus in use and can be used as a handle to carry the receptacle when the apparatus (10) is collapsed.

To facilitate numerous cycles of collapsing and un-collapsing, the collapsible or expandable, preferably flexible material must be reasonably durable. By durable it is meant that the container should resist mechanical and chemical stress, that is the material should not swell, soften or develop cracks, holes, or other defects during its normal use. Likewise, if the container is constructed of a lined material, the lining should not deteriorate or exfoliate. In one preferred embodiment of this invention, the container is also thermally insulated with additional material, or even more preferably, the flexible material is a thermally insulating material. But as is discussed below in the Method description, there is a need for relatively quick "cool-down" of the bag which allows for condensation of the perfume on the fabrics. Thus, the bag should not be perfectly insulated.

The collapsible or expandable, preferably flexible, material should have a natural vapor permeability not higher than 3000, preferably, not higher than 2000, and more preferably not higher than 1000 grams of water/$m^2$/day. Vapor permeability can be measured by a standardized test such as the ASTM E96 test, which will be known to those skilled in the art. The collapsible or expandable, preferably flexible, material can be essentially vapor impermeable, but it may be desirable for the container walls to have some limited permeability so the container can "breathe". Also, the collapsible or expandable, preferably flexible, material should be resistive to chemical corrosion, and ultra violet light. The various materials listed below as suitable cleaning and refreshment composition additives should not damage the container material over time. Likewise, the apparatuses of this invention may be used near a window wherein the sunlight might fade or otherwise damage the material. The container material should be selected to minimize this degradation due to natural sources. Suitable collapsible or expandable, preferably flexible, materials can be purchased from the Milliken Corp., in South Carolina, or the Sofinal Corp., in Belgium.

The containers of this invention can be formed from one sheet of collapsible or expandable, preferably flexible, material or from multiple sheets of material that are joined together in any appropriate manner. Those skilled in the art can contemplate many ways to join multiple sheets of material together to form a container. For example, the sheets can be sewn together, stapled, adhesively bonded, heat bonded, sonic bonded, or attached to one another by means that are known. The seams of container (12), if properly engineered, can form the container vent. By properly engineered, it is meant that the welds, stitches, bonds, staples, etc. of the container should be spaced so as to vent the desired amount of air during operation. Those skilled in the art will be able to determine the proper seam construct to achieve the desired venting without undue experimentation.

In addition to the at least one wall that defines an interior void space, the containers of this invention preferably comprise: at least one vent (28); a temperature controller (20) that is preferably active and is capable of changing and maintaining the air temperature within the interior void space (19) of container (12); an ultrasonic nebulizer (24), which is capable of producing a fine mist out of liquids and which will be used to deliver the refreshing and cleaning composition to the fabrics in the form of very small droplets, and thus, acts as a humidity provider that is capable of maintaining a certain level a relative humidity within said interior void space of the container (12); and an air circulation device (34), for example, a fan. Preferably, for the optimum deodorization, it is preferred to have air velocities around the garment between 0.05 to 10 m/s, more preferably between 0.1 and 5, most preferably between 0.5 and 2 m.s−1.

Figure 3:
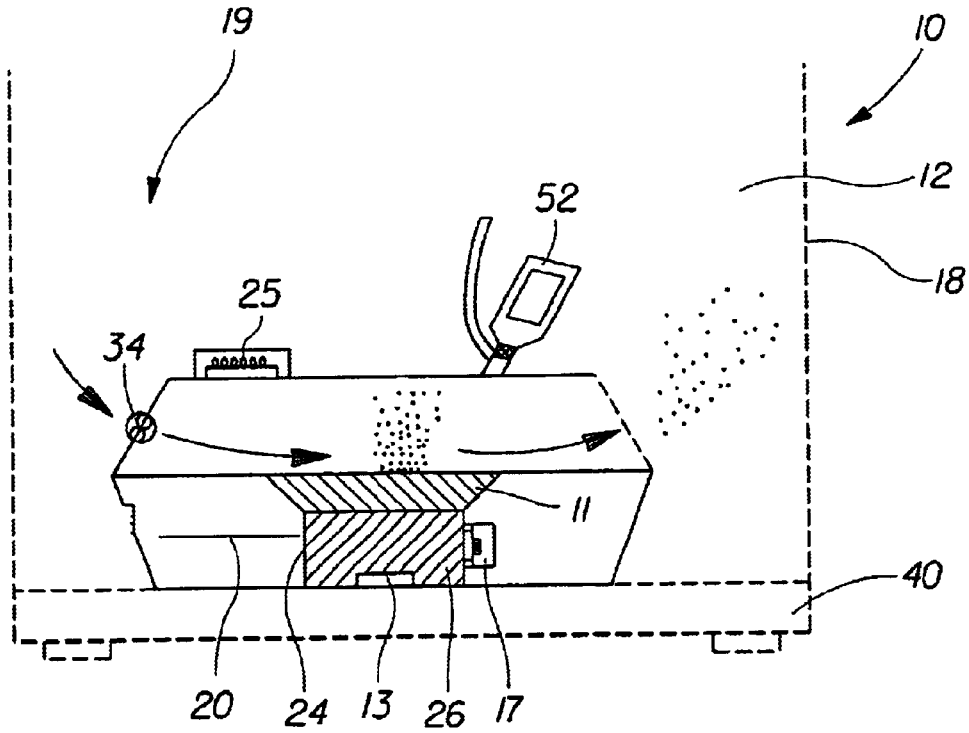
FIG. 3 is a profile schematic view of an ultrasonic nebulizer according to the present invention, shown in closed position, and running.

Preferably, the active temperature controller, the passive humidity controller, the ultrasonic nebulizer (24), and the air circulation device (34) are all within the interior void space (19) of container (12), as shown in schematic profile view of FIG. 3. Necessarily air circulation device (34) has an air inlet and an air outlet, and it is preferred, that both air inlet and air outlet are located within interior void space (19) of container (12) so that at least a portion of the air within the interior void space (19) of container (12) is recirculated. Likewise, air outlet of the air circulating device is at least about 30 cm, preferably at least about 25 cm, and more preferably at least about 20 cm from vent (28) such that a portion of the air circulated within the interior void space (19) of container (12) is vented to the exterior of the container.

The vent is preferably selected from the group consisting of the natural permeability of the flexible material, seams created between sheets of the flexible material, seams between the container opening and the flexible material, a void space in the container material, and mixtures thereof. By void space in the container material it is meant that the vent can be any appropriately sized hole or opening. The filter (30) can also be a component of the apparatus. The filter (30) is preferably located at the top of the apparatus (10), as shown in FIG. 1, or at the bottom in either close proximity to the fan (34), thereby removing the need for a vent and the apparatus may then work in close system or under the cover plate in close proximity to the ultrasonic nebulizer (24). Preferably the filter (30) is in close proximity, e.g. adjacent, to the vent. Even more preferably the apparatus, most preferably the vent comprises a humidity sink, e.g. condenser for condensing vapors before they are emitted from the container. Preferably the filter comprises an absorbent material, for example, activated carbon, to absorb fugitive chemical, perfumes, and malodorous compounds before they are emitted to the exterior of the container. Most preferably, the filter is a low-pressure filter that has a low resistance to air. Typical of such filter are commercially available from AQF under the trade name CPS® or from MHB filtration. Preferably, part up to the total surface of the air circulation device, e.g. fan may be covered by the filter. If part of the air circulation device is covered, lost of the perfume through the filter is minimized whilst when the whale air circulation device is covered one can have the air circulation device automatically switched off upon the end of the cycle thereby enabling deposition of the perfume onto the garment. Condensers and filters are well known to those skilled in the appliance arts.

Ultrasonic Nebulizer

It is an essential feature of the apparatuses of this invention that they utilize very small droplets of refreshing and cleaning composition—equivalent to vapors in terms of quality of distribution onto the surface of the garments being treated—to clean and refresh fabric articles as described above. In addition, it is an essential feature of said apparatuses that they be able to vaporize/nebulize volatile, as well as non-volatile compounds. Thus, it is an essential feature of these apparatuses, according to the present invention, that they comprise an ultrasonic nebulizer to vaporize the refreshing/cleaning composition used therein. Preferably, the temperature of the droplets is higher than room temperature because the refreshing and cleaning composition is heated by the hot protective liquid of the ultrasonic nebulizer (see more detailed description hereafter). The droplets are typically created within the container by an ultrasonic nebulizer (24) that turns a cleaning and refreshment composition, which comprises water and actives, into a very fine mist.

The water and actives, that is, the "cleaning and refreshment composition", or "fabric treatment composition" (these two terms are used interchangeably throughout this description and are intended to mean the same thing), can be added to the container in any appropriate way. The composition can be poured into the bag, poured into a reservoir that feeds into the ultrasonic nebulizer/humidifier, canisters can be used to inject the composition, or an absorbent substrate saturated with the composition can be placed in the bag. Substrates and compositions suitable for use in the methods of this invention are described in greater detail below. It is understood that those skilled in the art will know of other methods of adding actives to the container and those methods are within the scope of this invention. In a preferred embodiment of this invention, the refreshing and cleaning composition is contained inside a bottle that is removably connected to the apparatus. More preferably, the bottle is a recharge that is not refillable and comprises a pierceable cap. By pierceable cap, it is meant a closure that comprises a pierceable membrane. Preferably, the membrane is an elastomeric pierceable membrane that is inserted and maintained onto/into the cap. More preferably, the membrane is made such that once it has been pierced, it recloses so as to be substantially leak-tight. For example, leak-tight reclosable pierceable membranes can be made our of a laminate elastomer/PET membrane.

Figure 2:
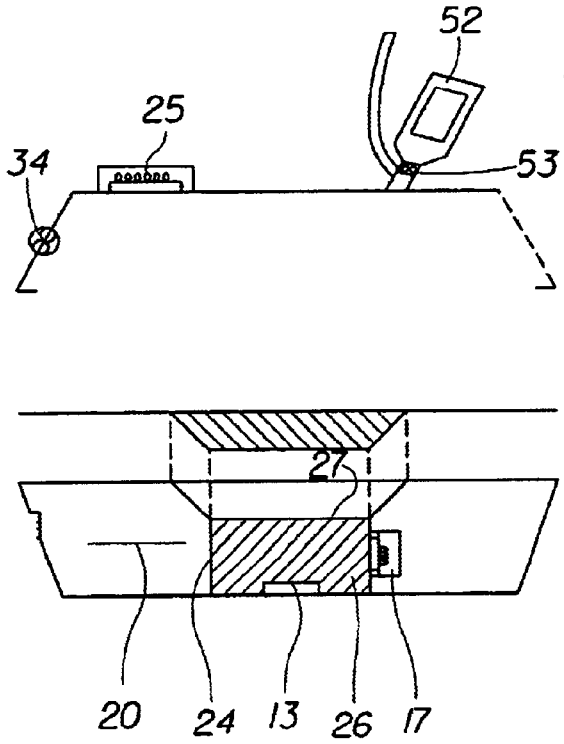
FIG. 2 is a profile schematic view of an ultrasonic nebulizer according to the present invention, shown in open position.

As discussed above, the apparatuses of this invention comprise a ultrasonic nebulizer and an air circulation device that work together to vaporize and distribute the cleaning and refreshment composition. By "work together" it is meant that the ultrasonic nebulizer is in fluid communication with the air outlet of the air circulation device such that as air is circulated within the interior void space of the container it contacts the ultrasonic nebulizer. Moreover, it is especially preferred that the ultrasonic nebulizer be in fluid communication with a fabric treatment composition that is "vaporized" by the ultrasonic nebulizer. By using the word "vaporized", it is not meant to mean only producing a fine mist by using heating. In the context of the present invention, the fine mist is produced by an ultrasonic nebulizer, which is using high-frequency waving at the surface of the liquid to detach droplets, rather than heating of the liquid. As previously explained, the fine mist that is produced by the nebulizer used in the present invention comprises small droplets of liquid with a diameter preferably comprised within the range of 1 to 35 $\mu$m, more preferably within the range of 1 to 20 $\mu$m. A fine mist of droplets differentiates from a vapor in that it contains droplets of liquid, while a vapor is only made of separate molecules of liquid. However, the fine mist produced by the nebulizer of the present invention is similar to a vapor in terms of properties of penetration into the fabrics. More importantly, it has been shown that the coverage of the surface of the garments being treated is equal to what is achieved with a vapor, which means that almost 100% of the surface of the fabric garments is covered by the mist, whereas a mere hand triggered spray would only provide localized coverage (like "spots") by the refreshing/cleaning composition. One such mechanical system is shown in FIGS. 2 and 3, which are schematic drawings of one possible arrangement of the mechanical components of the present invention. The fabric treatment composition is circulated throughout the interior void space of the container as air is circulated across the ultrasonic nebulizer carrying the vaporized fabric treatment composition. The fabric treatment composition is contained within cartridge (52) having a cartridge outlet (53), wherein the cartridge outlet is in fluid communication (not shown in FIGS. 2 and 3) with the ultrasonic nebulizer (24) via a cartridge receiver. Preferably, the cartridge (52) used in the refreshing/cleaning apparatus of the present invention is a non-refillable bottle (52) that comprises a pierceable cap. In such a case, the appliance comprises at least one piercing means, for example a needle, that pierces the pierceable cap of the bottle when said bottle is inserted into the appliance, thus establishing a fluid communication between the two.

The mechanical elements of apparatus 10 comprise, as a minimum, ultrasonic nebulizer (24) (as a humidity provider), a main heating element (25) that allows to raise the temperature of the air inside said container, and as discussed above, an air circulation device (34). Preferably, the apparatus also comprises a temperature controller. The ultrasonic nebulizer serves to "vaporized" the cleaning and refreshment composition into a very fine mist. The vaporized cleaning and refreshment composition raises the humidity within the interior void space (19) of container (12), thus, the ultrasonic nebulizer works as a humidity provider. In contrast, temperature controller (20) is preferably active, that is the temperature is read with temperature probe and this temperature is sent back to temperature controller (20). Based on the input from temperature probe, temperature controller (20) raises or lowers the temperature of the main beating element (25). Each of these mechanical elements will be known to those skilled in the appliance arts, and the size and power of each element can be selected based on the volume of the container (12). Many manufacturers market these elements, such as, Etri in France, Blackmann in Austria, and IRCA in Italy.

As previously explained, the vapor is supplemented by a nebulizer (24), which is used to cover the surface of the garments with a fine mist of volatile and non-volatile cleaning and refreshment compositions. Preferably the nebulizer is an ultrasonic device, most preferably providing droplets size between 1–60 microns, most preferably between 1–40 microns. Nebulizers, atomizers and the like devices that are appropriate for use in the present invention are well known to those skilled in the art. A suitable device for use herein is a nebulizer which has at least one ultrasonic sonotrode, or ultrasonic vibrating cell (13). Typical of such nebulizer is commercially available from Sono Tek Corporation, 2012 route 9W Building 3 in Milton N.Y. 12547 under the trade name Acu Mist®. If used, it is preferred to have frequency set up to at least 60 kHz, most preferably to at least 100 kHz so as to obtain droplets sizes below 60 microns, more preferably below 50 microns, most preferably below or equal to 40 microns. Still other examples of such devices can be purchased from the Omron, Health Care, GmbH, Germany, Flaem Nuove, S.p.A, Italy. Likewise, aerosol delivery systems, which are well known to the art, can be used to deliver the cleaning and refreshment compositions. More preferably, the nebulizer comprises protected cells (13). Indeed, a problem encountered with the use of cell containing nebulizer is their contamination from contact with the cleaning/refreshing composition, thereby causing build-up on the cell. As a result, the lifetime of the cells (13) is shortened. It has now been found that protection of the cells (13), in particular by contacting the cells (13) with a protective liquid or gel medium (26), e.g. demineralized water, the latter being covered by a membrane (27), so that this system is closed, i.e. leak-free, solved this problem. Furthermore, it has been found that by adding certain substances in case demineralized water is used as a protective medium (26), the output is greatly increased. Preferably, the liquid/gel ultrasonic cell protective medium (26) is a mixture of demineralized water with alcohol or more preferably a mixture of demineralized water with a surfactant. The man skilled in the art can appropriately choose the right proportions of alcohol or surfactant. Accordingly, the membrane (27) is defined as providing the closing of the system but does not prevent the energy waves transmittal. The thickness of the membrane (27) should be optimized so as to transmit the wavelengths and energy coming from the ultrasonic cells at the best rate. Preferably, the thickness of the membrane (27) is less than 200 $\mu$m, more preferably less than 100 $\mu$m, even more preferably less than 50 $\mu$m. Most preferably, the thickness of the membrane (27) is equal or less than 10 $\mu$m. It has been found that the thinner the membrane, the better the transmission of the wavelengths. In addition, it has been found that a very efficient transmission of energy from the ultrasonic cells to the refreshing and cleaning composition is achieved for a thickness that is less than 200 $\mu$m. Subsequently, the cleaning/refreshment composition (11) is added on top of this system. As a result, the lifetime of the cells are greatly enhanced. One advantage of this system is that it can be run empty of cleaning/refreshment composition (11) without the risk of destroying the cell and thus the nebulizer. Preferably, the membrane is a layer made of plastic film, and/or made of metal. Typical description of such apparatus can be found in BE 9900683 filed Oct. 14, 1999 in the name of Brodsky SPRL. This finding is all the more surprising as previous attempts to solve this problem were by level detectors. However, this did not prevent the build-up from the cleaning/refreshment onto the cell. In addition, it has been found that the distance between the top of the ultrasonic cells (13) and the membrane (27) affects the output rate of the ultrasonic nebulizer (24), for given type of protective medium (26), ultrasonic frequency, type and thickness of the membrane (27). It has further been found that each system presents several maxima (typically one or two), i.e. distances for which the output is greatly increased—which means the output rate of the nebulizer is not a linear function of the distance between the ultrasonic cells (13) and the membrane (27).

In addition, it has also been found a means to improve the low output of the nebulizer. Indeed, another problem encountered with conventional nebulizer is that of the coalescence of the droplets. Indeed, as the droplets are emitted into the air, the higher they are the more they coalesce therefore giving bigger droplets and thus falling back into the basin of the nebulizer. The present invention solved this problem in a simple manner by the addition of a blowing means like a fan, which is preferably located on top of the nebulizer so as to provide a horizontal air flow and hence directing the flow of small droplets through a grid. Typical description of such apparatus can be found in BE 9900682 filed Oct. 14, 1999 in the name of Brodsky SPRL.

It has been found that for the purpose of the present invention, i.e. refreshing and cleaning of fabric garments inside a closed container, the output of the ultrasonic nebulizer should be preferably at least 2 g/min., more preferably at least 3 g/min, per piezoelectric cell. This is crucial to achieve a sufficient distribution of product onto the fabric garment. It has been found that known ultrasonic nebulizers cannot achieve such an output. In addition, it has surprisingly been found that by warming up the protective liquid or gel medium that surrounds—or "encapsulates"—the ultrasonic cells (13), the output is greatly increased. Thus, the present invention provides an fabric refreshing and cleaning apparatus (10) wherein the refreshing and cleaning composition is vaporized to the garments by an ultrasonic nebulizer (24), said nebulizer comprising a built-in heating means (17) to warm up the protective medium (26) that protects the ultrasonic cells (13). It has been found that the output is greatly increased for the same ultrasonic cell power, especially for temperatures of the protective liquid above 30° C. At this point, it is important to note that the process of warming the protective liquid is by no means intended to vaporize the refreshing and cleaning composition, like in the apparatuses known in the art, which use steaming systems. In the system of the present invention, the benefit is achieved already for temperatures just above the room temperature. Of course, it has been shown that the higher the temperature, the better output. However, a very efficient increase of the output will be already achieved at temperatures of the protective liquid preferably above 30° C., more preferably above 40° C., and most preferably above 50° C.

Fabric Garments Hanging Means

Fabric articles can be suspended in the interior void space (19) of the treatment apparatus (10) by any appropriate method. One such method is using a bar is provided to suspend hangars. The garments hung in treatment apparatus (10) can also be weighted or stretched to improve wrinkle reduction. Hanging weights and stretching devices will be known to those skilled in the art. Preferably, the garments to be treated are mechanically stretched after placing them into the container and before starting the process. This stretching or so-called tensioning of the garment helps the relaxation of wrinkles during the process. Preferred stretching systems include weighted as well as lightweight compactable or retractable stretching systems, wherein the system comprises a tensioning device like a spring. The latter systems have the benefit of not adding extra weight to the cleaning and refreshing apparatus, along with the possibility of adjusting tensioning force and direction as required. Preferably, these systems are mounted inside the container at its bottom. One example of such as system is a rollerblind that is conventionally used as sun filter for cars and commercially available from Halfords. This system is a rollerblind which can be extended or compacted by means of a roll-up spring mechanism. Only slight modification of this system is needed to adapt it to the tensioning of garment. One preferred adaptation involves attaching the housing of this system at the bottom of the apparatus and providing one or more clamp at the other side so that the clamping and thus the stretching or tensioning of the garment in the apparatus is obtained. The tension of the spring can also be adjusted to the desired stretching force for a given garment. The size of the clamp can vary so that more than one clamp is attached to this system. Still, another variation involves having only one clamp which run along or partly along the blind tensioning system located opposite the housing of the system.

Treatment apparatus (10) can be free standing with the support of a rigid frame, or it can be suspended by a hanging member (45) from a support means (not shown). If treatment apparatus (10) is suspended by hanging member (45) no frame is required although frames are generally preferred to control and maintain the shape and volume of interior void space (19). In a preferred embodiment of the present invention the container (12) further comprises a rigid bottom portion (40), a rigid top portion (42) or both. These two rigid portions can be used to support the frame, house the mechanical elements of apparatus (10), and/or to serve as a housing for the collapsed container. Moreover, rigid bottom portion (40) and rigid top portion (42) can be designed to enhance the aesthetic characteristics of the apparatus, that is, there need not be any functionality to the rigid portions.

Volume Refreshment Rate

The apparatuses of this invention must simultaneously clean and refresh fabrics with vaporous compositions, and vent out the malodorous vapors. It is understood that separating the desirable active vapors from the malodorous vapors would be a complex task. To simplify the apparatuses of this invention a Volume Refreshment Rate has been determined that optimizes the venting of malodorous compounds while minimizing the loss of active components from the cleaning and refreshment composition.

The Volume Refreshment Rate is defined as the frequency that the total volume of air within the interior void space of the container is replaced, expressed in units of seconds$^{-1}$. If the apparatus vents substantially lower than 0.0004 $s^{-1}$ then venting becomes too weak, and deodorization performance deteriorates unless the cycle length is drastically increased. Theoretically, one volume refreshment per cycle could be enough to allow good deodorization. Supposing, for example, a cleaning and refreshment cycle takes 1 hour, of which the deodorization step would take approximately 40 minutes, this would mean a VR/s of 0.0004 $s^{-1}$. An exemplary Volume Refreshment Rate calculation is given in Example I below.

The Volume Refreshment Rate for the apparatuses of the present invention is preferably between about 0.0004 $s^{-1}$ and about 0.05 $s^{-1}$, and more preferably between about 0.001 $s^{-1}$ and about 0.03 $s^{-1}$.

Method

To properly clean and refresh a fabric article, one must address many aspects of the article's appearance. Specifically, the fabric article should at least be substantially free of odor and wrinkles after a cleaning and refreshing operation. It is often preferred that the article be perfumed to give it a pleasant odor, and it should be free of localized stains. The methods of this invention require at least two steps designed toward deodorizing, dewrinkling and/or perfume deposition on a fabric article. Additionally, a manual spot removal process for removing localized stains is provided, but the spot removal process is conducted outside of the apparatus. The conditions for each of these methods steps are described in greater detail below.

While the method steps of this invention can be carried out in any appropriate order, the deodorization step will be discussed first. Deodorization must be distinguished from odor-masking, which involves applying a pleasant scent to a fabric to mask, or cover up the odors on the fabric. Deodorization, as used herein, involves the actual removal or degradation of malodor causing chemicals. When the malodor causing constituents are removed or neutralized, the fabric article should have little or no residual odor. This step of the process can be carried out with ozone, which degrades odors, or with high temperatures and venting which removes the odor causing constituents.

The deodorization step is described herein as the first step as a matter of convenience. It is understood that the deodorization and dewrinkling steps can be carried out in any order. If a perfume deposition step is employed, it necessarily should follow the deodorization step, so that the perfume is not stripped off of the fabric immediately after it is laid down.

Thus, when deodorization is the first step, the first temperature should be at least about 45° C., preferably at least about 60° C., and most preferably at least about 70° C. and the first relative humidity should be least about 20%. At these relatively high temperatures, odor-causing chemicals are stripped off of fabrics, and then preferably removed from the container via the vent. Even more preferably, the vent comprises a filter so that the odorous emanations do not enter the environment outside of the container. When the first temperature and first relative humidity are reached, the process time, that is, the first time, can be from about 2 minutes to about 20 minutes, preferably from about 5 minutes to about 15 minutes, and even more preferably from about 8 minutes to about 12 minutes.

The deodorization step described above can be supplemented, or even replaced by treating the fabric articles with ozone. The use of ozone to neutralize odors causing chemicals and to sanitize garments, for example, medical gowns, is well known to the art. Specifically see, published patent applications DE 24 33 909 and FR 2059 841, both of which are incorporated herein by reference. For purposes of the methods disclosed herein, ozone can be introduced into the container from any appropriate source, such as an ultraviolet lamp or even a high voltage source. One or more ozone sources can be used and they can be placed in any convenient place in, or adjacent the exterior of the container. The ozone source must be sized according to the volume of the container with consideration for the surface area of the fabric articles being cleaned and refreshed. An alternative way to produce ozone for deodorization is the use of high voltage. For example, a wire can be placed in the container and approximately about 10,000 volts passed across the wire. This generally serves the same purpose as the UV lamp generating ozone. Those skilled in the art will know what type and size of equipment to use for a given container.

The second step of the present invention is directed to dewrinkling, which requires relatively high temperature and relative humidity. Good air circulation that agitates the fabrics and evenly distributes the active ingredients is beneficial to the dewrinkling step, but not necessary. For the second step, i.e. the dewrinkling step, the second temperature should be greater than "T" as defined by the equation: $T=60-(0.17*RH_2)$, wherein $RH_2$ is the second relative humidity in percent. $RH_2$ is of at least 50%, preferably of at least 75%, more preferably of at least about 85%, most preferably at least about 90%. Preferably, the second temperature is less than about 90° C., more preferably less than about 80° C., and most preferably less than about 70° C. When the second temperature and second relative humidity are reached, the process time, that is, the second time, can be from about 2 minutes to about 20 minutes, preferably from about 5 minutes to about 15 minutes, and even more preferably from about 8 minutes to about 12 minutes.

Finally, there is preferably a third step which involves a gradual cool down of the interior void space. As the temperature decreases, the amount of vapor that the air can retain in the air decreases, and when the air becomes saturated the vapors begin to condense. Naturally, vapors will condense on the fabric articles on the inside of the bag, and as these articles dry, the active ingredients, such as perfume, remain behind. As discussed briefly above, the methods steps of this invention are designed to deliver actives without undue waste and without saturating the fabrics to the point where they need additional drying. Preferably, during the third step in the process the temperature within the interior void space decreases to a third temperature wherein the third temperature is less than about 45° C., preferably less than about 40° C., and more preferably less than about 35° C. This third step can last for a third period of time, which can be from about 2 minutes to about 20 minutes, preferably from about 3 minutes to about 10 minutes, and even more preferably from about 3 minutes to about 5 minutes.

As discussed in greater detail below, the vapor inside the container is preferably a cleaning and refreshment composition. The cleaning refreshment composition can be added to the container directly, via a sheet/substrate, in a cartridge or any other means that will be known to those skilled in the art. Preferably, the cleaning and refreshment composition is in a cartridge that is introduced into the interior void space of the container and the cleaning and refreshment composition is released from the cartridge into the interior void space of the container.

Cleaning/Refreshment Composition

The cleaning/refreshment composition preferably comprises water and optionally a member selected from the group consisting of surfactants, perfumes, preservatives, bleaches, auxiliary cleaning agents, shrinkage reducing compositions, organic solvents and mixtures thereof. Said composition can include both volatile and non-volatile ingredients, since non-volatile ingredients can be vaporized/nebulized into a fine mist for deposition onto the fabric garments, as well as volatile compounds. The preferred organic solvents are glycol ethers, specifically, methoxy propoxy propanol, ethoxy propoxy propanol, propoxy propoxy propanol, butoxy propoxy propanol, butoxy propanol, ethanol, isopropanol, wrinkle removing agents, in-wear anti-wrinkling agents, semi-durable press agents, odor absorbing agents, volatile silicones and mixtures thereof. Fabric shrinkage reducing compositions that are suitable for use in the present invention are selected from the group consisting of ethylene glycol, all isomers of propanediol, butanediol, pentanediol, hexanediol and mixtures thereof. More preferably, the fabric shrinkage reducing compositions are selected from the group consisting of neopentyl glycol, polyethylene glycol, 1,2-propanediol, 1,3-butanediol, 1-octanol and mixtures thereof. The surfactant is preferably a nonionic surfactant, such as an ethoxylated alcohol or ethoxylated alkyl phenol, and is present at up to about 2%, by weight of the cleaning/refreshment composition. Preferred auxiliary cleaning agents include cyclodextrins and dewrinkling agents, such as silicone containing compounds. Especially preferred anti-wrinkling agents include volatile silicones, some of which can be purchased from the Dow Corning Corporation. One such volatile silicone is D5 cyclomethicone decamephyl cyclopenta siloxane. Typical fabric cleaning/refreshment compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. The entire disclosure of the You et al. patent is incorporated herein by reference. Additionally, cleaning/refreshment compositions are described in co-pending U.S. patent application Ser. No. 08/789,171, which was filed on Jan. 24, 1997, in the name of Trinh et al, now U.S. Pat. No. 5,912,408. The entire disclosure of the Trinh et al. Application is incorporated herein by reference. And shrinkage reducing compositions for use in this invention can be found in co-pending U.S. Provisional Application No. 60/097,596, entitled "Cleaning Compositions that Reduce Fabric Shrinkage", which was filed by Strang and Siklosi, on Aug. 24, 1998, now expired. The entire disclosure of the Strang and Siklosi application is incorporated herein by reference.

It has been found that addition of a certain amount of alcohol into the refreshing/cleaning composition diminishes the surface tension of said liquid composition, as well as its viscosity. Thus, the liquid is much easier to vaporize into fine particles by the ultrasonic nebulizer, which means a higher output rate of the nebulizer. Similarly, the addition of a certain amount of surfactant into the liquid refreshing and cleaning composition diminishes the surface tension, and makes it much easier for the ultrasonic nebulizer to vaporize/nebulize the liquid into a fine mist, hence a higher output rate. This is one of the reasons which makes alcohol and/or surfactant(s), or any other chemical compound capable of diminishing the surface tension of the liquid refreshing/cleaning composition, preferred components of the refreshing/cleaning liquid composition.

All along the description of the present invention, the output rate of the ultrasonic nebulizer that is described, is preferably a dry output rate. By dry output, it is meant that the fine mist produced by the ultrasonic nebulizer is a non-wetting mist. This can be explained by the fact that the size of the particles that make the mist is very small. In addition, given the very small particle size, the distribution of product onto a surface is very regular. Thus, all area of the fabric garments are evenly treated for a given quantity of product that is nebulized. This even coverage avoids any localized deposition of product that would lead to wetting of the garments or the interior of the refreshing/cleaning device. Such a small size of particles is achieved by providing the top portion of the nebulizer with a fan: the size of the particles produced by the nebulizer is uneven. However, due to the fan, the biggest particles are re-deposited onto the surface of the refreshing/cleaning liquid, and only the smallest particles can form the fine mist that is blown into the container for deposition onto the garments.

Spot Cleaning Composition

The user of the present process can be provided with various spot cleaning compositions to use in the optional pre-spotting procedure of this invention. These compositions are used to remove localized stains from the fabrics being treated, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave no visible stains on the fabric. Therefore, in a preferred aspect of this invention there are provided spot cleaning compositions which are substantially free of materials that leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred spot cleaning composition will also contain a cleaning solvent such as butoxy propoxy propanol (BPP) at a low, but effective, level, typically about 1% to about 4%, preferably about 2%.

Preferred spot cleaning methods and compositions are described in U.S. Pat. No. 5,789,368, to You et al. which was incorporated herein by reference above. Additionally, spot cleaning methods and compositions are described in U.S. Pat. No. 5,630,847, which issued on May 20, 1997, to Roetker.

Treatment Member

In one embodiment, a treatment member is provided to assist in removing localized stains from fabrics. In a preferred aspect of this invention, the spot cleaning composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulosic sheet or pad, or the like. In contact with and extending outward from this base material can be multiple protrusions. Specific examples of treatment members can be found in U.S. Pat. No. 5,789,368, to You et al. which was incorporated herein by reference above.

In another embodiment, the treatment member to assist in removing localized stains from fabrics is built-in with the appliance, while hand-held. By hand-held, it is meant that while said implement is built-in, i.e. attached and not removable from the appliance, it must be carried and manipulated by the user, for example, like a pen that is linked to the main apparatus by a wire.

In addition, it has been found that an ultrasonic implement has the advantage of providing a very efficient means to remove difficult stains, while having a shape and size that is compatible with the fact that it must be held in hand by the user during use, and then arranged in a compartment located in the housing of the refreshing/cleaning apparatus. The ultrasonic technology is compatible with these two conditions. In a preferred embodiment of the present invention, said hand-held ultrasonic pre-treatment implement has an active part (i.e. sonotrode) vibrating at a frequency of at least 20 kHz with an amplitude of at least 10 $\mu$m and up to 100 $\mu$m. It is preferably shaped generally like a pen, and is attached to the main appliance by a wire that provides power to the ultrasonic part. Also preferably, the wire comprises a pipe that is capable of transporting a composition to the ultrasonic nozzle, to be dispensed to the stain being treated, in order to enhance the spot-removal process.

One example of an ultrasonic implement for treatment of fabrics, suitable for pre-treatment of fabric garments, is given in Procter & Gamble's U.S. patent application Ser. No. 60/165,784 filed Nov. 16$^{th}$ 1999, now expired. An example of the structure of an ultrasonic implement suitable for use as a pre-treatment implement for removing localized stains on fabric garments can also be found in Procter & Gamble's PCT application number WO 00/28874, published May 25$^{th}$ 2000.

Absorbent Stain Receiving Article

An absorbent stain receiving article, sometimes referred to herein as a stain receiver, can optionally be used in the optional pre-spotting operations herein. Such stain receivers can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. One preferred type of stain receiver consists of a nonwoven pad, such as a thermally bonded air laid fabric ("TBAL"). Another highly preferred type of stain receiver for use herein comprises polymeric foam, wherein the polymeric foam comprises a polymerized water-in-oil emulsion, sometimes referred to as "poly-HIPE". The manufacture of polymeric foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., now U.S. Pat. No. 6,013,589 titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Serial No. 60/077,955, filed Mar. 13, 1998 by T. A. DesMarais, et al., now expired titled "Abrasion Resistant Polymeric Foam And Stain Receivers Made Therefrom", the disclosure of which is incorporated herein by reference.

The various stain receivers described herein, and described in the references incorporated herein by reference, preferably comprise a liquid impermeable backsheet. The backsheet can be made of, for example, a thin layer of polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

The following Examples further illustrate the invention, but are not intended to be limiting thereof.

EXAMPLE I

Two extra-large men's jackets that have been exposed to cigarette smoke and wrinkled using standardized methods, are placed on clothes hangers. These jackets are then hung on the inside of a plastic bag that has two co-planer flat ends (the top and bottom) with the side walls being cylindrical and slightly outwardly bowed near the center. For illustration purposes only, the bag can be thought of as shaped like an egg shell with the top and bottom cut off. The container has a door for accessing the interior, and the door is closed with a zipper. A circle opening near the bottom of the bag serves as the vent and the vent remains open at all times during this process. There is an activated carbon filter in the opening that comprises the vent.

On the interior of the bag is a fan, a ultrasonic nebulizer that acts as a humidity provider, a main heating element for heating the air inside said container, and a reservoir that is in fluid communication with the ultrasonic nebulizer. The ultrasonic nebulizer further comprises a heating element, separate from the main heating element. Finally, the container comprises vents. A vent is provided near the bottom of the bag to act as an air intake. Similarly, an exhaust air vent is provided at the top of the container. Approximately 100 to 150 ml of a composition comprising approximately 99% water and 1% perfume, by weight, is poured into the reservoir and the door is closed.

An exterior "on/off" switch is turned on to begin the fabric refreshment process. The switch is connected to a programmable microprocessor that controls the multi-step process. First, the temperature is raised to about 70° C. as well as the relative humidity of about 50%. This is accomplished by running the fan and the ultrasonic nebulizer which comprises a heater. This first step lasts for about 10 to 15 minutes without the fan running. About 120 ml of product is nebulized during that first step. For the second step, which is the drying step, the temperature is raised by starting the main heating element. Thus, the composition that has been nebulized during the first step is heated by the main heating element, dispersed by the fan and vented through the exhaust vent on top of the container. Typical temperature levels to be achieved during this second step are above 75° C.

Finally, with the fan running, the main heating element is turned off and the interior of the bag cools naturally to about 45° C. in less than about 10 minutes. The fan is turned off automatically, and an indicator light signals that the process is complete. The jackets are removed and they are substantially wrinkle free, deodorized and ready to wear.

EXAMPLE II

Two extra-large men's jackets that have been exposed to cigarette smoke and wrinkled using standardized methods, are placed on clothes hangers. These jackets are then hung on the inside of a plastic bag that has two co-planer flat ends (the top and bottom) with the side walls being cylindrical and slightly outwardly bowed near the center. For illustration purposes only, the bag can be thought of as shaped like an eggshell with the top and bottom cut off. The container has a door for accessing the interior, and the door is closed with a zipper. An opening is provided near the bottom of the bag to act as an air intake. Similarly, an exhaust air vent is provided at the top of the container. Likewise, the bag material is a polyester micro fiber material coated on the inside with a silicone composition, and has essentially no vapor permeability.

On the interior of the bag is a fan, an ultra violet lamp, a ultrasonic nebulizer, a thermocouple and a receptacle for receiving a cartridge that contains a cleaning and refreshment composition. The receptacle is in fluid communication with the ultrasonic nebulizer. The cleaning and refreshment composition comprises approximately 100 to 125 ml of a composition comprising a demineralized water base with 1% perfume and 2.5% Silwet™ (a surfactant), by weight. After the cartridge is connected to the receptacle, the door is closed.

An exterior "on/off" switch is turned on to begin the fabric refreshment process. The switch is connected to a programmable microprocessor that controls the multi-step process. First, the ultraviolet lamp is turned on to produce ozone. The lamp remains lit for approximately 10 minutes. The fan is running at half speed during this first step. For the second step, the ultraviolet lamp (ozone source) is turned off, the temperature is raised to about 50° C. and the relative humidity is raised to greater than about 75%. This is accomplished through the introduction of the nebulized cleaning and refreshment composition that is nebulized by the ultrasonic nebulizer. This second step lasts for about 7 to 12 minutes.

As a third step, the ultrasonic nebulizer is turned off, while the main heating element is still running and heating the air within the container at about 80° C. Finally, the heater stops, the fan is turned on full speed, and the interior of the bag cools naturally to about 45° C. in less than about 10 minutes. The fan is turned off automatically, and an indicator light signals that the process is complete. The jackets are removed and they are substantially wrinkle free, deodorized and ready to wear.

EXAMPLE III

Cleaning and Refreshing Compositions

While the cleaning and refreshment compositions of this invention can comprise water and perfume only, additional fabric treatment components can also be included. For example, fabric cleaning/refreshment compositions according to the present invention, for use in the methods described herein, are prepared as follows:

| Ingredient | % (wt.) | Range (% wt.) |
|---|---|---|
| Water | 96.0 | 95.1–99.9 |
| Perfume | 0.5 | 0.05–1.5 |
| Silwet ™ (surfactant) | 1 | 0.05–5 |
| Ethanol or Isopropanol | 2.5 | Optional to 4% |
| Solvent (e.g. BPP) | 0 | Optional to 4% |
| Hydrogen peroxide | 0 | Optional to 4% |

(pH range from about 6 to about 8)

EXAMPLE IV

Spot Cleaning Compositions

A spot cleaning composition for use in the present invention, preferably with a dispenser as defined above, and with a TBAL or poly-HIPE foam stain receiver, is prepared as follows:

| INGREDIENT | Anionic Composition (%) |
|---|---|
| Hydrogen peroxide | 1.000 |
| Amino tris(methylene phosphonic acid)* | 0.0400 |

-continued

| INGREDIENT | Anionic Composition (%) |
|---|---|
| Butoxypropoxypropanol (BPP) | 2.000 |
| $NH_4$ Coconut $E_1S$ | 0.285 |
| Dodecyldimethylamine oxide | 0.031 |
| Magnesium chloride | 0.018 |
| Magnesium sulfate | 0.019 |
| Hydrotrope, perfume, other minors, | 0.101 |
| Kathon preservative | 0.0003 |
| Water (deionized or distilled) | 96.5 |
| Target pH | 6.0 |

*Stabilizer for hydrogen peroxide

Preferably, to minimize the potential for dye damage as disclosed hereinabove, $H_2O_2$-containing pre-spotting compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

What is claimed is:

1. An apparatus for treating a fabric article comprising:

a) a collapsible or expandable container that is made from a material that defines an interior void space having an open volume of between about 0.75 $m^3$ and about 0.05 $m_3$, and an opening;

b) an ultrasonic nebulizer operatively associated with the container to maintain a relative humidity within the interior void space of the container;

c) an air circulation device operatively associated with the container to circulate at least a portion of air within the interior void space of the container;

d) optionally, a vent operatively associated with the air circulation device such that at least a portion of the air circulating the interior void space of the container is vented to exterior of the container; and e) optionally, a filter being located in close proximity to the air circulating device or covering at least a portion of the air circulating device.

2. An apparatus according to claim 1 wherein said air circulation device comprises a fan.

3. An apparatus according to claim 1 wherein said ultrasonic nebulizer comprising a housing, said housing being divided into at least two compartments by a membrane, said membrane comprising a flexible film, such that at least one compartment is liquid and vapor tight, said nebulizer further comprising a built-in heating means and at least one piezoelectric vibrating cell for ultrasonic wave generation located in said liquid and vapor tight compartment and encapsulated by a liquid or gel protective medium, a high-frequency generator for exciting said at least one piezoelectric vibrating cell, wherein said liquid or gel medium is heated by said built-in heating means to a temperature of at least 30° C.

4. An apparatus according to claim 3 wherein said liquid or gel medium encapsulating said at least one piezoelectric vibrating cell is a demineralized water-based medium.

5. An apparatus according to claim 3 wherein said membrane has a thickness of less then 200 $\mu$m.

6. An apparatus according to claim 3 wherein said membrane has a thickness of about 10 $\mu$m.

7. An apparatus according to claim 3 wherein said ultrasonic nebulizer has an output of at least 5 g/min.

8. An apparatus according to claim 3 wherein said output is dry output, and die mist produced by the ultrasonic nebulizer is a non-wetting mist.

9. An Apparatus according to claim 1 wherein said container can be collapsed to at least about 50% of its open volume.

* * * * *

UNITED STATES PATENT AND TRADEMARK OFFICE

CERTIFICATE OF CORRECTION

PATENT NO. : 6,726,186 B2
DATED : April 27, 2004
INVENTOR(S) : Gaaloul et al.

It is certified that error appears in the above-identified patent and that said Letters Patent is hereby corrected as shown below:

Title page,
Insert Item:
-- [30] Foreign Application Priority Data
August 16, 2000 (EP)……..00870799 --

Signed and Sealed this

Seventh Day of June, 2005

JON W. DUDAS
*Director of the United States Patent and Trademark Office*